United States Patent [19]

Tkaciukas

[11] 3,945,524

[45] Mar. 23, 1976

[54] SELF-FEEDING BOTTLE

[76] Inventor: Eugenia Tkaciukas, 83 Boyden Ave., Maplewood, N.J. 07040

[22] Filed: June 21, 1974

[21] Appl. No.: 481,641

[52] U.S. Cl. ..... 215/11 R; 222/181; 248/103

[51] Int. Cl.[2] ..... A61J 9/06

[58] Field of Search .... 215/11 R, 11 B, 11 C, 11 D; 248/102, 103, 104, 105; 222/181

[56] References Cited

UNITED STATES PATENTS

| | | | |
|---|---|---|---|
| 179,995 | 7/1876 | Bray | 248/103 |
| 227,075 | 4/1880 | Thompson | 215/11 R |
| 892,800 | 7/1908 | Black | 248/103 |
| 1,020,136 | 3/1912 | Feely | 248/103 |
| 1,304,066 | 5/1919 | Klenetzky | 248/103 |
| 2,056,096 | 9/1936 | Etter | 222/181 X |
| 3,065,873 | 11/1962 | Plate | 215/11 R |
| 3,082,985 | 3/1963 | Herdman | 248/103 |

*Primary Examiner*—Donald F. Norton
*Attorney, Agent, or Firm*—Behr & Woodbridge

[57] ABSTRACT

A bottle holder and clamp, fitted with tubing and nipple permitting unattended bottle feeding of an infant from the contents of a bottle enclosed in the device.

2 Claims, 6 Drawing Figures

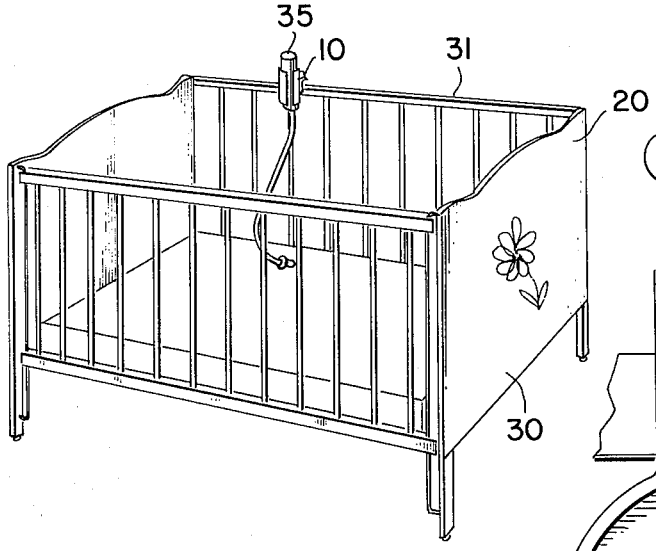
FIG. 1
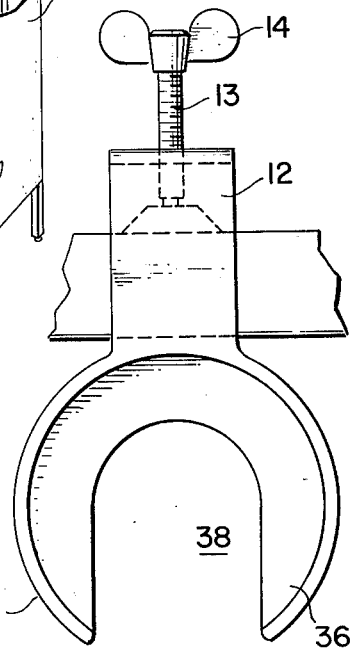
FIG. 3
FIG. 2
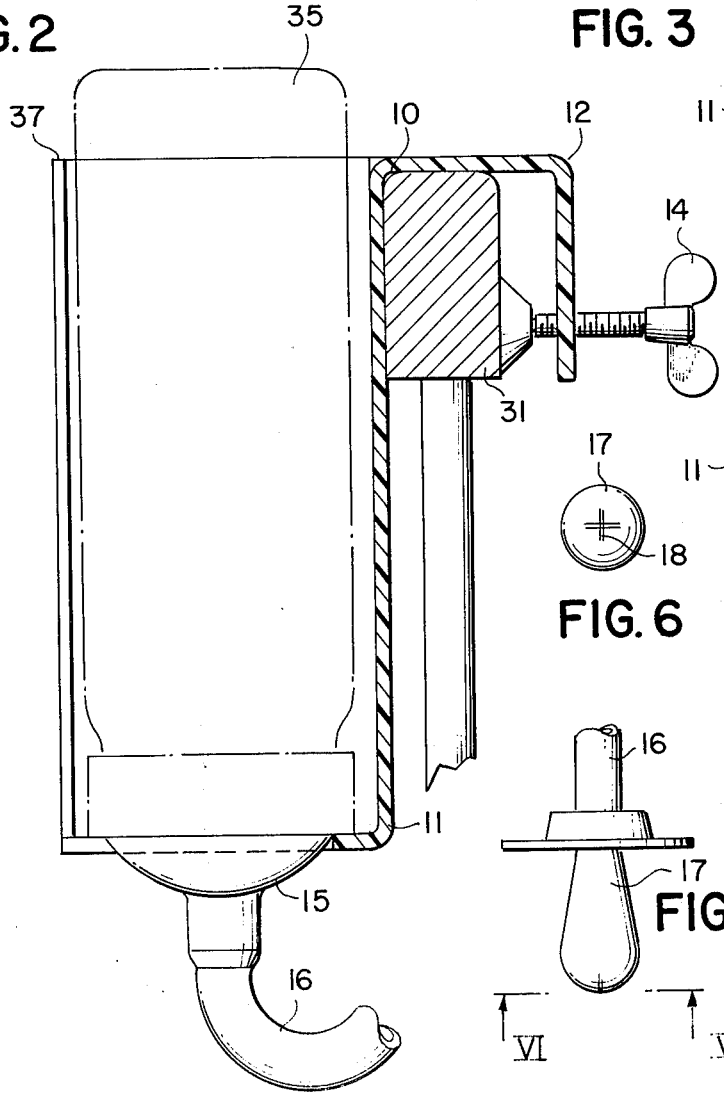
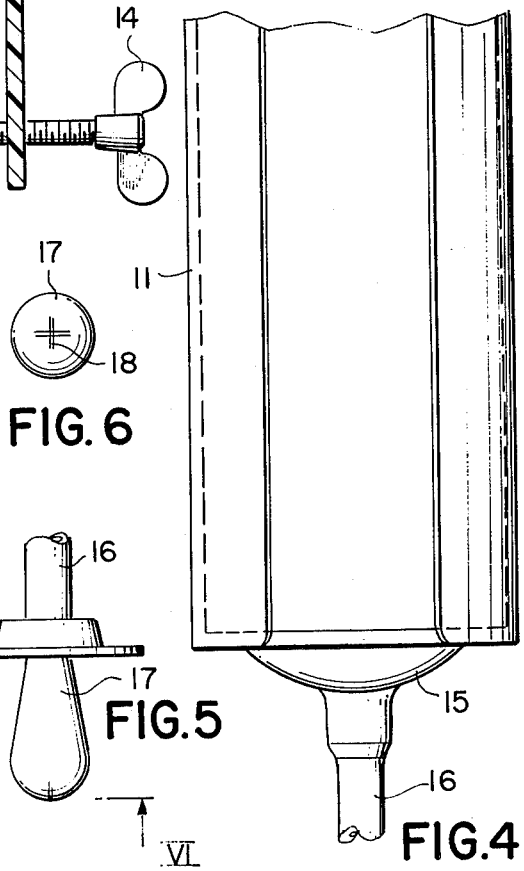
FIG. 4
FIG. 6
FIG. 5

SELF-FEEDING BOTTLE

SUMMARY OF THE INVENTION

My invention relates to a device for the bottle feeding of babies, and particularly to a bottle holder with clamp with attached tubing terminating in a nipple which permits a baby to drink from the contents of a bottle enclosed in the device without supervision. A filled bottle is capped and placed in the holder. The holder may be clamped to the top rail of a playpen or to the headboard of a crib. Flexible tubing is attached to the device with a nipple mounted on the free end of the tubing.

BRIEF DESCRIPTION OF THE DRAWING

The objects and features of the invention may be understood with reference to the following detailed description of an illustrative embodiment of the invention, taken together with the accompanying drawings in which:

FIG. 1 is a perspective view of the invention in use;
FIG. 2 is a sectional view of the invention;
FIG. 3 is a plan view of the invention;
FIG. 4 is a side view of the invention;
FIG. 5 is a side view of the nipple; and
FIG. 6 is an end view of the nipple taken along line III—III of FIG. 5.

DESCRIPTION OF THE PREFERRED EMBODIMENT

Turning now descriptively to the drawings, in which similar reference characters denote similar elements throughout the several views, FIGS. 1–6 illustrate the invention 10 which consists of a bottle holder 11 fitted with a clamp 12 that may be fastened by a thumbscrew 14 to the rail 31 of a crib 30. A conventional baby's milk bottle 35 may be inserted into the holder 11, with the bottle 35 capped by a bottle top 15 fitted to a length of flexible tubing 16 that terminates in a nipple 17 fitted with an *x*-shaped valve slot 18.

The bottle holder 11 is in the form of a hollow open tube, completely open at its rear end 37 and fitted with a U-shaped opening 38 at its forward end 37, with the rear end opening of a size to permit free passage of a conventional baby's bottle. The U-shaped opening 38 at the forward end 36 is of a size to permit the central portion of the bottle cap 15 to extend beyond opening 37 while restraining the peripheral section of the bottle cap 15 so that a bottle 35 may be retained in the inverted position when the holder is clamped in place with the forward end 36 of the holder oriented downwards.

Clamp 12 of the device preferably extends from the side of the rear end 37 of the holder 11 and permits fastening the holder section 11 so that its axis is oriented in the vertical plane or at any desired angle to the vertical plane, when clamp 12 is tightened by thumbscrew 14 to a crib rail 31.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A device for use in feeding a baby comprising
a bottle holder fitted with a clamp, and
a bottle top fitted with tubing, the free end of which terminates in a nipple, said bottle top being detachably engageable to a bottle,
said bottle holder being of tubular construction, with one end completely open, said open end of a size to admit a baby's bottle fitted with said bottle top, the other end of the said bottle holder being sufficiently constricted to permit the passage therethru of the tubing attached to the bottle top engageable to the bottle; but small enough to restrain the passage therethru of said bottle top, said bottle holder having an axial length substantially equal to the axial dimension of the bottle to be retained therein said clamp fitted to the bottle holder being of a size to fit about the rail of a crib, and fitted to an external side of the bottle holder.

2. The combination as recited in claim 1 in which the side of the bottle holder is fitted with a continuous slot of a width greater than the width of the tubing leading from the bottle top, said slot joining a U-shaped opening in the constricted end of the bottle holder through which the tubing is fitted in the installed position of the device.

* * * * *